US005947148A

United States Patent [19]

DeVito

[11] Patent Number: 5,947,148

[45] Date of Patent: Sep. 7, 1999

[54] FLUID DELIVERY HOSE RECOVERY SYSTEM

[76] Inventor: Robert DeVito, 27 A Sorrel Dr., Shirley, N.Y. 11967

[21] Appl. No.: 09/003,997

[22] Filed: Jan. 7, 1998

[51] Int. Cl.[6] ..... B65H 75/34

[52] U.S. Cl. ..... 137/355.26; 251/129.04; 242/390.8; 137/899; 137/355.2

[58] Field of Search ..... 251/129.04; 137/355.2, 137/355.26, 899; 242/390.8

[56] References Cited

U.S. PATENT DOCUMENTS

| | | | |
|---|---|---|---|
| 2,315,085 | 3/1943 | Churchwood . | |
| 2,963,227 | 12/1960 | Lambert | 137/355.2 |
| 3,699,578 | 10/1972 | Fiorentino | 343/225 |
| 3,732,570 | 5/1973 | Fiorentino | 343/225 |
| 4,012,002 | 3/1977 | McDonald et al. | 242/86 |
| 4,066,093 | 1/1978 | Egerstrom | 137/355.2 |
| 4,187,962 | 2/1980 | Henry | 222/173 |
| 4,306,314 | 12/1981 | Griffiths | 251/129.04 |
| 4,595,122 | 6/1986 | Yoshida et al. | 222/14 |
| 4,632,329 | 12/1986 | Burley | 242/86.52 |
| 5,263,824 | 11/1993 | Waldbeser et al. | 251/129.04 |
| 5,588,636 | 12/1996 | Eichholz et al. | 251/129.04 |

*Primary Examiner*—A. Michael Chambers
*Attorney, Agent, or Firm*—Galgano & Burke

[57] ABSTRACT

Fluid delivery hose recovery systems for a movable, fluid delivery vehicle. There are several embodiments for the system as each has a fluid delivery hose, a rewinding mechanism for the hose, a wireless remote control for activating the rewinding mechanism and a receiver operatively connected to the rewinding mechanism for receiving a signal from the remote control to rewind the hose. Some of the embodiments for the system include a mechanism for disabling the rewinding mechanism. Additionally, some of the embodiments of the present invention can be used with vehicles delivering flammable fluids.

20 Claims, 2 Drawing Sheets

FLUID DELIVERY HOSE RECOVERY SYSTEM

The present invention is directed to a wireless, remotely controlled fluid delivery hose recovery system for rewinding a fluid delivery hose, preferably for a flammable fluid delivery vehicle.

BACKGROUND OF THE INVENTION

An automated fluid delivery hose recovery system is highly advantageous to a fluid delivery person, such as a fuel oil or propane delivery person. During a fuel delivery, a fuel oil delivery person typically stretches out a hose to pump fuel into a tank located behind a house, drags the nozzle end back to his fluid delivery vehicle after pumping fuel into the tank and then, pushes a control for the rewind motor to rewind the length of the hose that had been extended. However, as the fuel oil delivery person drags the nozzle back to his fluid delivery vehicle, the hose often inadvertently wraps around a bush or other objects, e.g. snow, on the ground. As such, the loop of the hose could easily become stuck on several different objects, many of which could damage the hose or interfere with the rewinding operation. As can be appreciated, there is a need to provide a system which is easy to use and conveniently and quickly rewinds a hose.

Previously suggested is a remote control which included a control wire extending through the delivery hose. This suggested system, while being remotely controlled, included serious disadvantages. For example, if the control wire installation became frayed due to the repeated unwinding and rewinding of the delivery hose, it would be possible for electrical signals passing through the wire to contact the flammable fluid with potential devastating effects. Furthermore, the repeated winding and rewinding would otherwise tend to wear out the remote control leading to a shorter than desired life expectancy.

SUMMARY OF THE INVENTION

The present invention provides a system wherein the fuel oil delivery person simply presses a button on his remote control and then as he walks back the nozzle end of the hose, the hose is rewinding onto the reel. Therein, the hose is less susceptible to become stuck to an object on the ground because the length of the hose extended for fluid delivery would be either rewound onto the reel or on the ground in front of the fluid delivery person as he walked back to his fluid delivery vehicle, i.e., there would not be any portion of the hose behind him as he walked back to his fluid delivery vehicle. Consequently, the fluid delivery person would save time during a delivery as the hose would be rewound onto the reel by the time he reached his fluid delivery vehicle.

Further, if the hose somehow were to become stuck on an object on the ground, the fluid delivery person would see the disturbance as he walked back toward his fluid delivery vehicle. Therein, he could fix the problem on the spot instead of wasting time walking back toward the house looking for the disturbance as is generally done.

Therefore, it is highly advantageous to provide a system in which the user can remotely activate the rewinding mechanism for a hose. One preferred embodiment of the present invention includes a fluid delivery hose, a rewinding mechanism for the hose, switches for disabling the rewinding mechanism, and a wireless remote control having a transmitting mechanism to activate the rewinding mechanism and a switch for activating the transmitting mechanism. The rewinding mechanism is operatively connected to a receiver which activates the rewinding mechanism in response to a signal from the transmitting mechanism. In particular, in response to a signal, the receiver, via a relay, activates a power source which drives a motor connected to a reel. The reel therein rewinds the hose.

Further, it is advantageous to provide a system having safety switches for disabling the rewinding mechanism at specific times. One preferred switch automatically disables the rewinding mechanism when the fluid delivery vehicle is in motion. Such a switch is located on the fluid delivery vehicle and prevents accidental actuation of the motor when the vehicle is in motion.

A second preferred switch mechanism disables the rewinding mechanism while fluid is passing through the fluid delivery hose. In particular, a detecting mechanism is positioned along the fluid line of a fluid delivery vehicle and is connected to a relay. The relay is wired as a safety and is connected to at least a pair of switches either of which can disable the rewinding mechanism. As fluid is detected as passing through the fluid line into the fluid delivery hose, the detecting mechanism automatically signals the relay which then signals either switch to disable the rewinding mechanism. Either switch can disable the rewinding mechanism as one is connected to the receiver and the other is connected to the relay between the power source and the motor.

As an additional safety feature, the remote can be constructed to only operate while the switch activating the transmitting mechanism is depressed or activated by the delivery person. Therefore, if the delivery person let go of the transmitter, either intentionally or accidentally, the rewinding mechanism would stop. Such a remote has what is known as a "momentary transmitter".

As yet another safety feature in a preferred embodiment of the present invention, the remote can be constructed to only operate if the receiver is in the line-of-sight of the transmitting mechanism.

Additionally, the fluid delivery hose recovery system is highly advantageous as it can be used in conjunction with vehicles for delivering flammable fluids including gasoline, fuel oil, propane, and the like without the use of electrical wires passing through the delivery hose in close proximity to the flammable fluid.

BRIEF DESCRIPTION OF THE DRAWINGS

These and other advantages of the present invention will become apparent from the following description considered in conjunction with the accompanying drawings which disclose the present invention. It is to be understood that the drawings are to be used for the purpose of illustration only and not as a definition of the invention.

In the drawings, wherein similar reference numerals denote similar elements throughout several views.

DETAILED DESCRIPTION OF THE DRAWINGS

Figure 1:
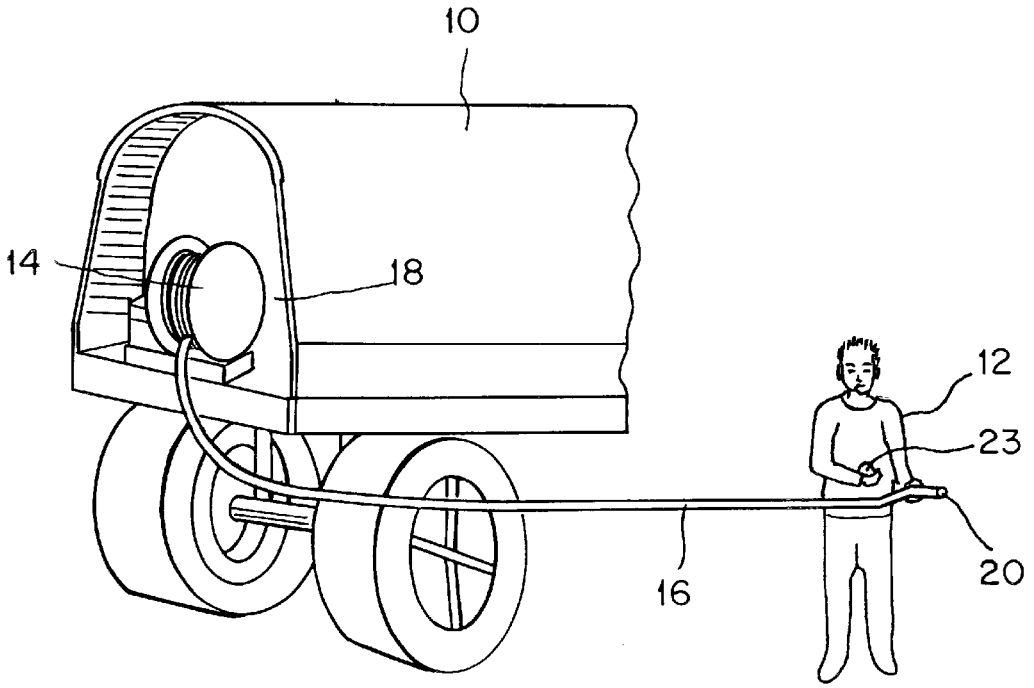
FIG. 1 is a perspective view of a fluid delivery hose recovery system of one embodiment of the present invention.

FIG. 1 illustrates one fluid delivery hose recovery system of the present invention attached to a fluid delivery vehicle 10. In particular, within the frame of vehicle 10 is a reel 14 upon which a fluid delivery hose 16 rewinds. Connected to reel 14 is a motor 18 which drives reel 14 to rewind hose 16. The motor 18 is supplied with power from a power source 28 as shown in FIG. 2.

As can also be seen in FIG. 1 is a fluid delivery person 12 holding both a remote 23 and the nozzle end 20 of hose 16. When delivery person 12 actuates a button switch 27 on remote 23 (as seen best in FIG. 3), the transmitting mechanism within remote 23 sends a signal to activate the rewinding mechanism of the present invention. According to this preferred embodiment, the transmitting mechanism is activated only while button 27 is depressed though other forms of transmitters can be utilized.

Figure 2:
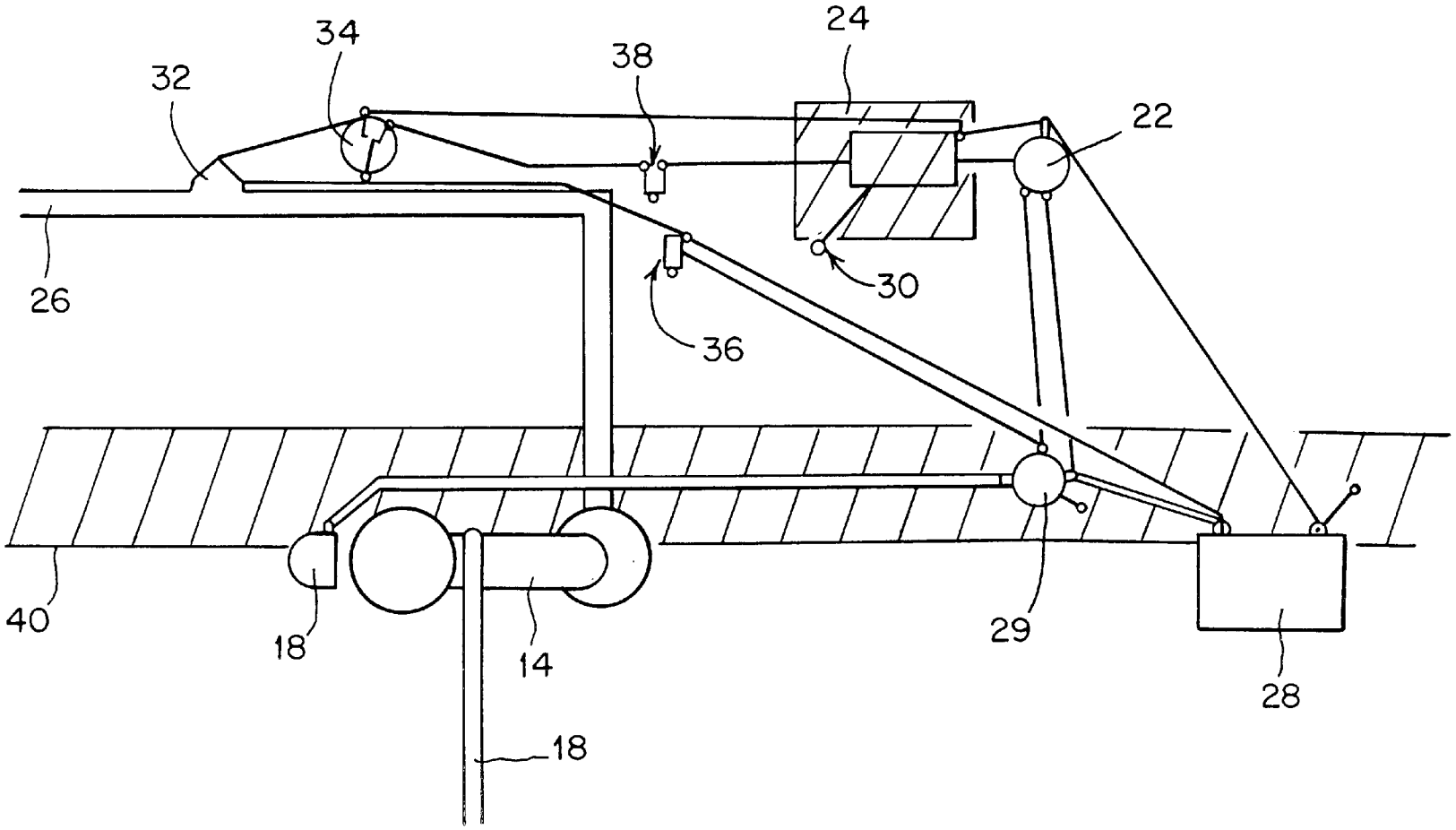
FIG. 2 shows a rewinding mechanism of one embodiment of the present invention.
Figure 2:
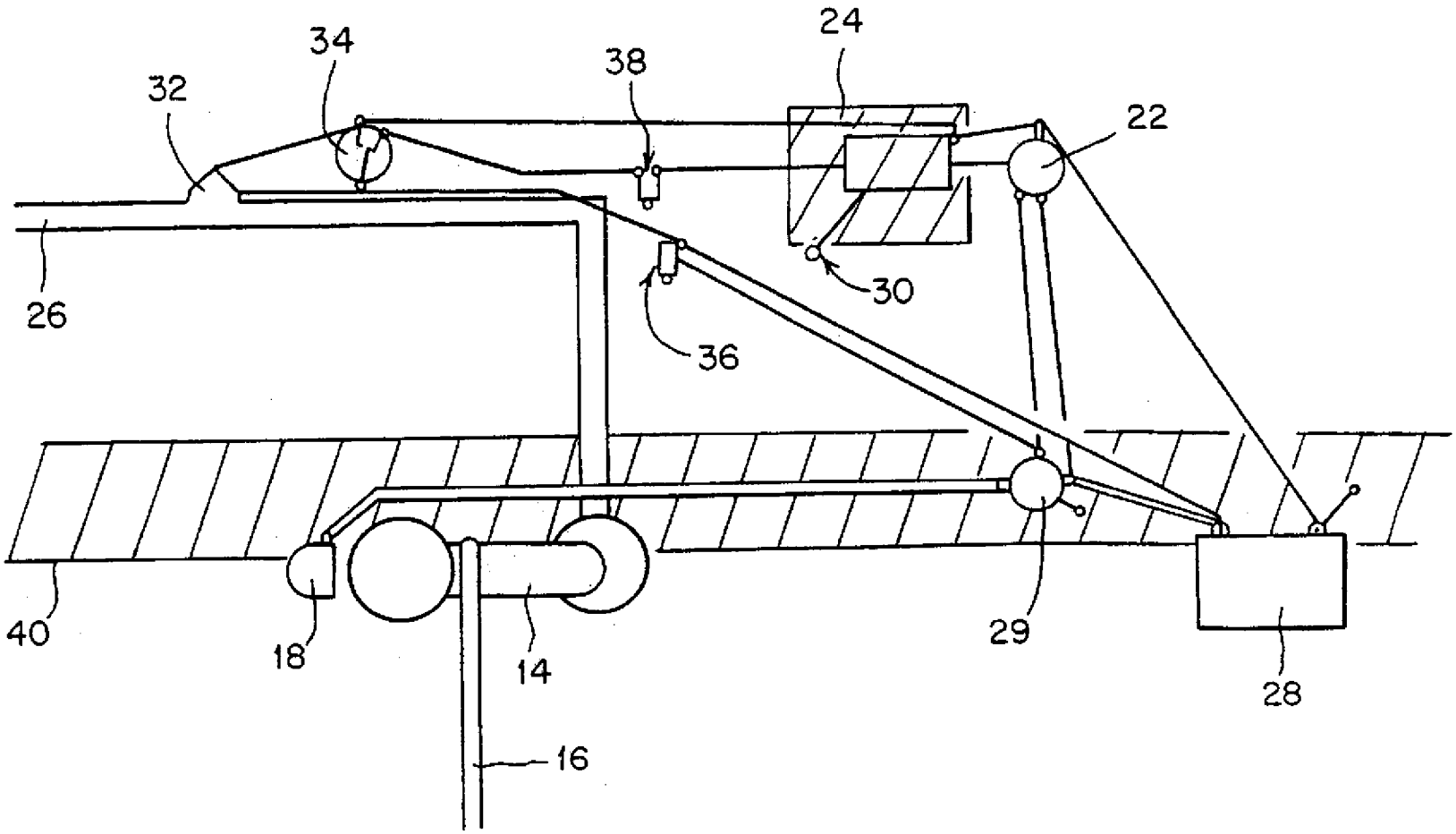

Referring now to FIG. 2, receiver 24 is shown as having an antenna 30 for receiving a signal. From the present description, those skilled in the art will appreciate that several receivers may be used in conjunction with the present invention, including the High Memory Universal Coaxial Receiver Model 412HM, sold by Lift Master of Elmhurst, Illinois. Receiver 24, in response to a signal from the transmitting mechanism, activates power source 28 via a relay 22. Power source 28 then supplies rewind motor 18, via a relay 29, with power to rewind reel 14. Hose 16 then rewinds onto reel 14.

Although power source 28 is shown as an independent battery positioned relative to vehicle frame 40, the rewinding mechanism may be wired such that the battery of vehicle 10 or the vehicle alternator provides power to the rewinding mechanism. Alternatively, receiver 24 could be connected to a clutch for engaging motor 18 thereby providing power to the rewinding mechanism.

Also seen in FIG. 2, switches 36 and 38 are provided for disabling the rewinding mechanism while fluid is passing through hose 16. A detecting mechanism 32 is shown positioned along line 26 to detect when fluid is passing through line 26. Although other detecting mechanisms may be used in the present invention, one possible detecting mechanism 32 that can be used is the Padel Type Flow Control, Part #6806801 Model SM590 sold by Scully of Wilmington, Mass. As fluid is passing through line 26, detecting mechanism 32 automatically signals relay 34 to disable the rewinding mechanism. Relay 34 can then cause switch 38 to disable receiver 24 thereby disabling the rewinding mechanism or relay 34 can cause switch 36 to disable power source 28 or relay 29 thereby preventing accidental actuation of rewind motor 18 while fluid is passing through line 26. While the illustrated embodiment is preferred, other embodiments may provide one or more switches for disabling the rewinding mechanism.

Relay 34 can take the form of a butterfly valve of the type currently used on the market to rev an engine to provide more power to the fluid pump. This safety feature of the present invention could include a butterfly valve in conjunction with switches 36 and 38 to prevent accidental actuation of the rewinding mechanism while fluid is being pumped through hose 16.

Figure 3:
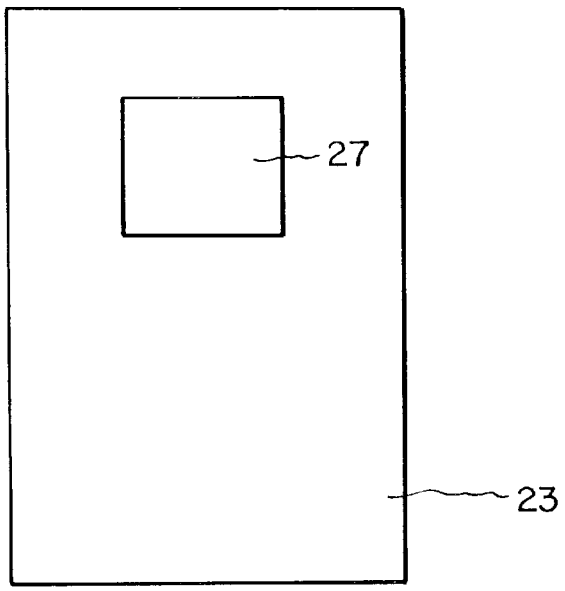
FIG. 3 is an enlarged view of a remote control of the present invention.

Referring now to FIG. 3, a remote control 23 is shown having button 27 to activate the transmitting mechanism (not shown) within remote 23. Although other remote controls may be used, one that can be used is the Model 64LM Remote Control Transmitter sold by Lift Master of Elmhurst, Illinois. As for button 27, it is preferred that a push button switch is used although a push/pull switch or any other means to activate the transmitting mechanism may be used. Further, it is preferable that a spring biased switch is used.

In order to further minimize the occurrence of accidental injury, remote 23 preferably comprises a momentary transmitter which does not transmit unless button 27 is depressed by the operator. Therefore, if the remote 23 is dropped or if the operator becomes incapacitated, for example due to illness, the rewind mechanism will not continue to rewind the hose.

What is claimed is:

1. A fluid delivery hose recovery system for a movable, fluid delivery vehicle comprising:

a fluid delivery hose, means for rewinding said hose, said rewinding means connected to said hose, a remote control comprising means for transmitting a signal and means for activating said transmitting means, means for receiving a signal from said transmitting means, said signal receiving means operatively connected to said rewinding means wherein said rewinding means is activated in response to said signal, and means for disabling said rewinding means when said fluid delivery vehicle is in motion, said disabling means connected to said fluid delivery vehicle.

2. A fluid delivery hose recovery system according to claim 1 wherein said rewinding means is disposed within said fluid delivery vehicle.

3. A fluid delivery hose recovery system according to claim 1 wherein said rewinding means comprises a motor.

4. A fluid delivery hose recovery system according to claim 3 wherein said signal receiving means is connected to a means for supplying power to said motor.

5. A fluid delivery hose recovery system according to claim 1 wherein said rewinding means comprises a clutch.

6. A fluid delivery hose recovery system according to claim 1 wherein said power supplying means comprises a battery.

7. A fluid delivery hose recovery system according to claim 1 wherein said activating means of said remote control comprises a switch.

8. A fluid delivery hose recovery system according to claim 1 wherein said transmitting means operates only when said activating means is being activated.

9. A fluid delivery hose recovery system according to claim 1 wherein said signal receiving means receives said signal from said transmitting means only when said signal receiving means is in the line-of-sight of said transmitting means.

10. A fluid delivery hose recovery system for a movable, fluid delivery vehicle comprising:

a fluid delivery hose, means for rewinding said hose, said rewinding means connected to said hose, a remote control comprising means for transmitting a signal and means for activating said transmitting means, means for receiving a signal from said transmitting means, said signal receiving means operatively connected to said rewinding means wherein said rewinding means is activated in response to said signal, and means for disabling said rewinding means when fluid is passing through said hose, said disabling means connected to said rewinding means.

11. A fluid delivery hose recovery system according to claim 10 wherein said disabling means comprises means for detecting fluid passing through said hose.

12. A fluid delivery hose recovery system according to claim 11 wherein said disabling means comprises a valve member connected to both said detecting means and said rewinding means, said valve member triggering a switch disabling said rewinding means in response to a signal from said detecting means that fluid is passing through said hose.

13. A fluid delivery hose recovery system according to claim 10 wherein said rewinding means is disposed within said fluid delivery vehicle .

14. A fluid delivery hose recovery system according to claim 10 wherein said rewinding means comprises a motor.

15. A fluid delivery hose recovery system according to claim 14 wherein said signal receiving means is connected to a means for supplying power to said motor.

16. A fluid delivery hose recovery system according to claim 10 wherein said signal receiving means is connected to a clutch for engaging said motor.

17. A fluid delivery hose recovery system according to claim 10 wherein said power supplying means comprises a battery.

18. A fluid delivery hose recovery system according to claim 10 wherein said activating means comprises a switch.

19. A fluid delivery hose recovery system according to claim 10 wherein said transmitting means operates only when said activating means is being activated.

20. A fluid delivery hose recovery system according to claim 10 wherein said signal receiving means receives said signal from said transmitting means only when said signal receiving means is in the line-of-sight of said transmitting means.

* * * * *

UNITED STATES PATENT AND TRADEMARK OFFICE

CERTIFICATE OF CORRECTION

PATENT NO. : 5,947,148
APPLICATION NO. : 09/003997
DATED : September 7, 1999
INVENTOR(S) : Robert DeVito It is certified that error appears in the above-identified patent and that said Letters Patent is hereby corrected as shown below:

Delete the title page and substitute therefore the attached title page showing the corrected illustrative figure.

Delete Drawing Sheet 2 of 2 and substitute therefore the attached Drawing Sheet 2 of 2 consisting of the corrected FIG. 2.

Signed and Sealed this
Twenty-second Day of February, 2011

David J. Kappos

David J. Kappos
*Director of the United States Patent and Trademark Office*

United States Patent [19]

DeVito

[11] Patent Number: 5,947,148

[45] Date of Patent: Sep. 7, 1999

[54] FLUID DELIVERY HOSE RECOVERY SYSTEM

[76] Inventor: Robert DeVito, 27 A Sorrel Dr., Shirley, N.Y. 11967

[21] Appl. No.: 09/003,997

[22] Filed: Jan. 7, 1998

[51] Int. Cl.[6] ..... B65H 75/34

[52] U.S. Cl. ..... 137/355.26; 251/129.04; 242/390.8; 137/899; 137/355.2

[58] Field of Search ..... 251/129.04; 137/355.2, 137/355.26, 899; 242/390.8

[56] References Cited

U.S. PATENT DOCUMENTS

| | | | |
|---|---|---|---|
| 2,315,085 | 3/1943 | Churchwood | |
| 2,963,227 | 12/1960 | Lambert | 137/355.2 |
| 3,699,578 | 10/1972 | Fiorentino | 343/225 |
| 3,732,570 | 5/1973 | Fiorentino | 343/225 |
| 4,012,002 | 3/1977 | McDonald et al. | 242/86 |
| 4,066,093 | 1/1978 | Egerstrom | 137/355.2 |
| 4,187,962 | 2/1980 | Henry | 222/173 |
| 4,306,314 | 12/1981 | Griffiths | 251/129.04 |
| 4,595,122 | 6/1986 | Yoshida et al. | 222/14 |
| 4,632,329 | 12/1986 | Burley | 242/86.52 |
| 5,263,824 | 11/1993 | Waldbeser et al. | 251/129.04 |
| 5,588,636 | 12/1996 | Eichholz et al. | 251/129.04 |

*Primary Examiner*—A. Michael Chambers
*Attorney, Agent, or Firm*—Galgano & Burke

[57] ABSTRACT

Fluid delivery hose recovery systems for a movable, fluid delivery vehicle. There are several embodiments for the system as each has a fluid delivery hose, a rewinding mechanism for the hose, a wireless remote control for activating the rewinding mechanism and a receiver operatively connected to the rewinding mechanism for receiving a signal from the remote control to rewind the hose. Some of the embodiments for the system include a mechanism for disabling the rewinding mechanism. Additionally, some of the embodiments of the present invention can be used with vehicles delivering flammable fluids.

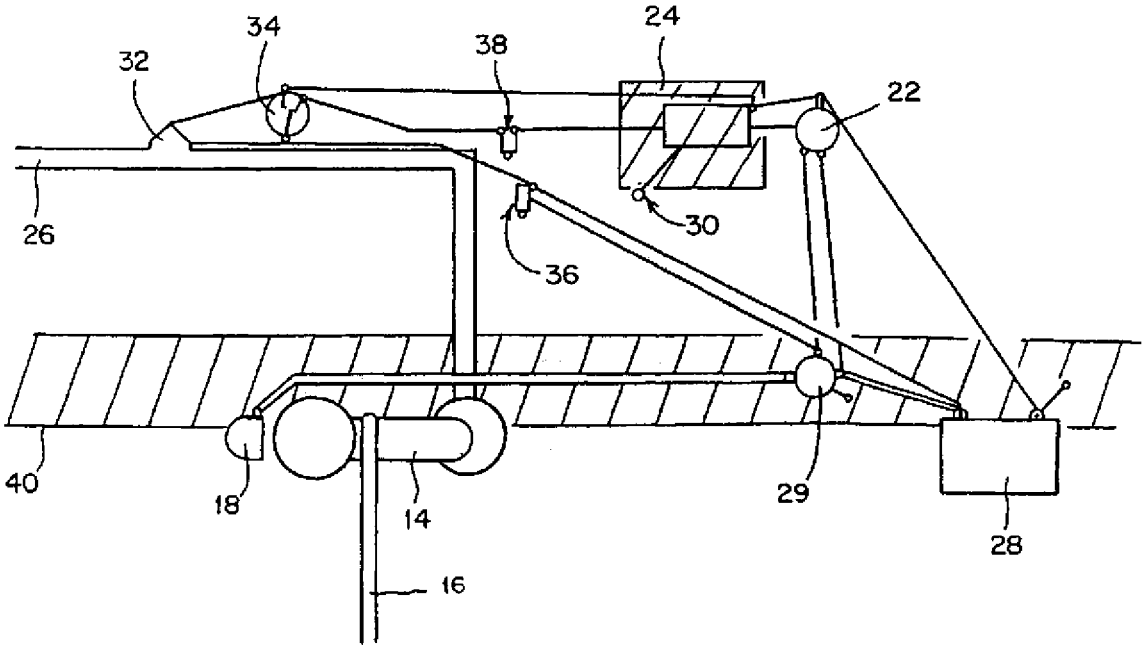

20 Claims, 2 Drawing Sheets